US005455545A

United States Patent [19]

Garcia

[11] Patent Number: 5,455,545

[45] Date of Patent: Oct. 3, 1995

[54] COMPACT LOW-LOSS MICROWAVE BALUN

[75] Inventor: Jose M. Garcia, North Bergen, N.J.

[73] Assignee: Philips Electronics North America Corporation, New York, N.Y.

[21] Appl. No.: 163,488

[22] Filed: Dec. 7, 1993

[51] Int. Cl.[6] ..... H01P 5/10

[52] U.S. Cl. ..... 333/26; 333/116

[58] Field of Search ..... 333/109, 112, 333/115, 116, 25, 26

[56] References Cited

U.S. PATENT DOCUMENTS

| | | | |
|---|---|---|---|
| 3,164,790 | 1/1965 | Oh | 333/116 |
| 4,254,386 | 3/1981 | Nemit et al. | 333/128 |
| 4,460,877 | 7/1984 | Sterns | 333/26 |
| 4,673,898 | 6/1987 | Redmond | 333/109 |
| 5,280,292 | 1/1994 | Tondryk | 333/109 X |

OTHER PUBLICATIONS

Tyrrell, "Hybrid Circuits for Microwaves", Proceedings of the I.R.E., vol. 35, Nov. 1947, pp. 1294–1306.

Bex, "New Broadband Balun", Electronics Letters, Jan. 23, 1975, vol. 11, No. 2, pp. 47–48.

Pozar, Microwave Engineering, Section 8.5: The Quadrature (90°) Hybrid, pp. 411–415; Section 8.8: The 180° Hybrid, pp. 435–440.

Reed et al., "A Method of Analysis of Symmetrical Four–Port Networks", IRE Transaction on Microwave Theory and Techniques, Oct. 1956, pp. 246–252.

Mayer et al., "Novel Branchline Couplers for Monolithic Microwave Integrated Circuits", Technische Universitat Hamburg–Harburg, AB Hochfrequenztechnik, pp. 1157–1162.

Khilla, "New Tunable Branch Line Coupler", Applied Microwave, Spring 1991, pp. 98–102 and 107–108 and 109–110.

*Primary Examiner*—Paul Gensler

*Attorney, Agent, or Firm*—Robert J. Kraus

[57] ABSTRACT

A microwave balun is constructed by combining a four-transmission-line branch-line coupler with a single-transmission-line delay element. This construction results in a simplified, compact arrangement for combining first and second signals applied to respective first and second ports, phase shifted by 180°, and providing the combined signal at a third port. The balun is a reciprocal device and may be operated in reverse with a signal applied to the third port to obtain outputs at the first and second ports.

8 Claims, 2 Drawing Sheets

COMPACT LOW-LOSS MICROWAVE BALUN

BACKGROUND OF THE INVENTION

1. Field of the Invention

The invention relates to a microwave transformer device and, in particular, to a balanced-to-unbalanced transformer device. This type of device is commonly referred to as a balun.

2. Description of Related Art

A balun is often used when it is desired to couple a balanced system or device to an unbalanced system or device. A typical example is the coupling of a two-line (balanced) circuit, such as a cellular telephone circuit, to a single-line (unbalanced) circuit, such as an antenna circuit. Another example is as a signal splitter/phase shifter for use with a balanced mixer.

In some uses, such as in portable cellular telephones, it is important that a balun meet three criteria. It must be compact, have a minimum insertion loss, and have a narrow passband to minimize power wastage. Although prior art baluns are known which accomplish one or two of these objectives, none are known which satisfactorily accomplish all three.

SUMMARY OF THE INVENTION

It is an object of the invention to provide a balun which accomplishes all three of the above-mentioned objectives.

In accordance with the invention, a balun is constructed by combining a branch-line coupler with a delay element that is coupled to a first input of the balun. The branch-line coupler includes: first and second inputs; first and second outputs; a first delay element having a characteristic impedance of $Z_0/\sqrt{2}$ and coupling the first input to the first output through a phase shift of 90°; a second delay element having a characteristic impedance of $Z_0/\sqrt{2}$ and coupling the second input to the second output through a phase shift of 90°; a third delay element having a characteristic impedance of $Z_0$ and coupling the first and second inputs through a phase shift of 90°; and a fourth delay element having a characteristic impedance of $Z_0$ and coupling the first and second outputs through a phase shift of 90°. The delay element coupled to the first input of the balun comprises a fifth delay element having a characteristic impedance of $Z_0$ and coupling the first input of the branch-line coupler to the first input of the balun through a phase shift of 90°. An impedance means having a characteristic impedance of $Z_0$ terminates the first output, the second input of the branch-line coupler comprises a second input of the balun, and the second output of the branch-line coupler comprises an output of the balun.

In a preferred embodiment of the invention, the balun is formed in microstrip or stripline, to simplify construction. In order to conserve space, especially for baluns operating at frequencies corresponding to wavelengths of significant size with respect to the balun itself, each of the transmission line means comprises a meandering conductive pattern formed on a dielectric substrate, and the transmission line means are disposed in close proximity to each other. To ensure that the coupling between adjacent portions of the conductive patterns uniformly affects the phase shifts of each of these patterns, the patterns are arranged such that there is at least one linear transmission line segment disposed between each meander pattern and each adjacent meander pattern, and such that the meander patterns of the first, second, third and fourth transmission line means are arranged symmetrically with respect to each other.

DESCRIPTION OF THE PREFERRED EMBODIMENT

Figure 1:
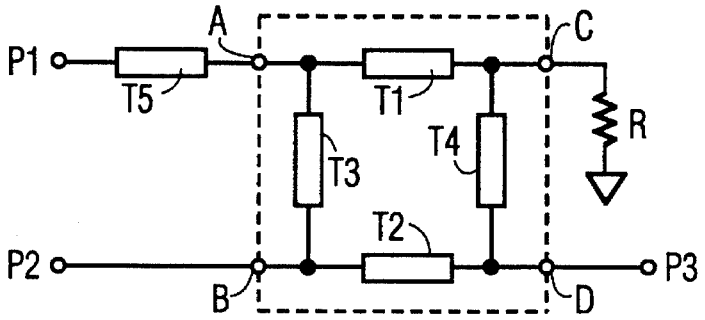
FIG. 1 is a schematic illustration of a balun in accordance with the invention.

The balun illustrated schematically in FIG. 1 comprises a branch-line coupler, including four interconnected transmission lines T1–T4, a fifth transmission line T5, and a resistive termination impedance R. The branch-line coupler, which is shown enclosed within a dashed-line box, is a symmetrical device having two pairs of ports A,B and C,D. Either pair of ports may serve as inputs, while the other pair serves as outputs.

In the illustrated embodiment, ports A and B serve as inputs, while ports C and D serve as outputs. Input A is coupled to output C through transmission line T1, which has a characteristic impedance of $Z_0/\sqrt{2}$ and an electrical length of $\lambda_0/4$ to provide a phase shift of 90°. The symbol $\lambda_0$ represents that wavelength corresponding to an operating frequency band having a center frequency $f_0$. Input B is coupled to output D through transmission line T2, which has a characteristic impedance and electrical length equal to that of T1. Input A is coupled to input B through transmission line T3, which has a characteristic impedance of $Z_0$ and an electrical length of $\lambda_0/4$ to provide a phase shift of 90°. Output C is coupled to output D through transmission line T4, which has a characteristic impedance and electrical length equal to that of T3.

The balun has first and second input ports P1 and P2 for receiving respective first and second input signals and a single output port P3 for providing an output signal. The first input port P1 is coupled to input A through transmission line T5, which has a characteristic impedance of $Z_0$ and an electrical length of $\lambda_0/4$. Input B and output D serve as the second input port P2 and the output port P3, respectively, of the balun. Output C is terminated to ground through the impedance R, which has the characteristic impedance $Z_0$.

Figure 2:
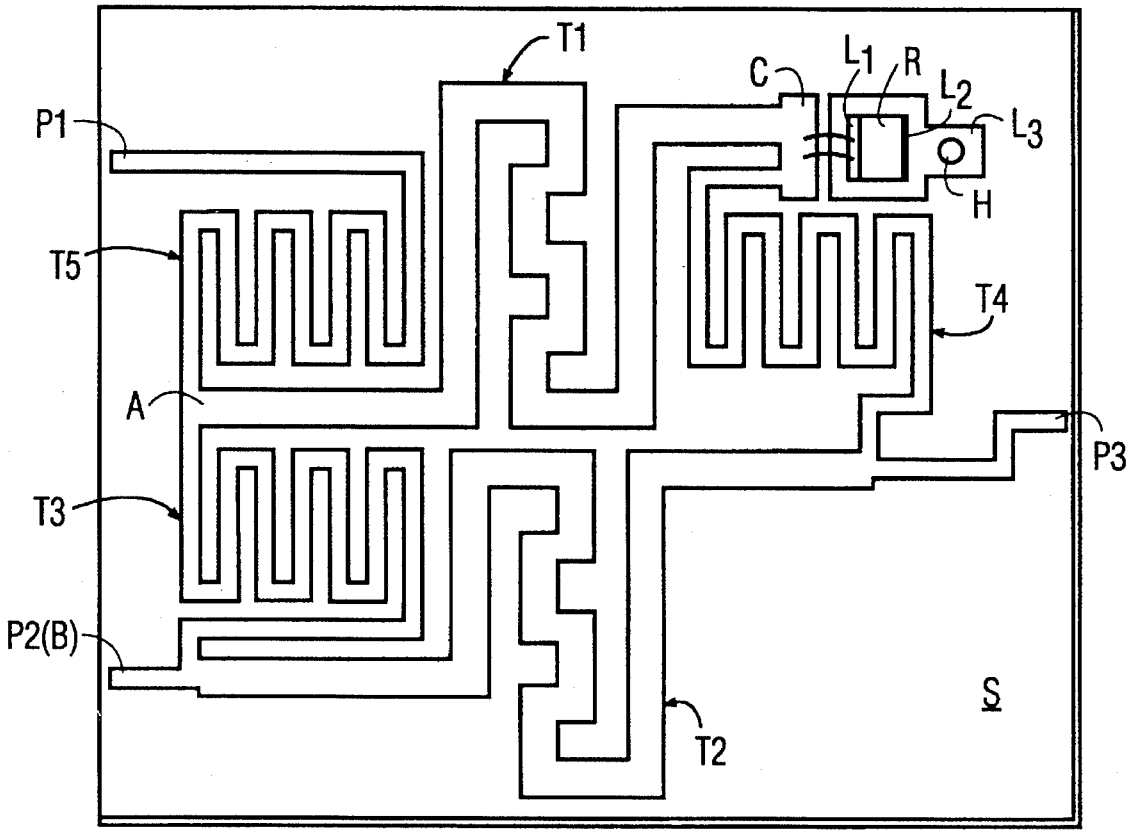
FIG. 2 is a top view (not to scale) of a preferred embodiment of the balun which is illustrated schematically in FIG. 1.

FIG. 2 illustrates a physical embodiment of the balun shown schematically in FIG. 1. The balun comprises a dielectric substrate S having the transmission lines formed in microstrips on one side and having a ground plane formed on an opposite side (which is not visible in FIG. 2). Preferably the substrate comprises a thin dielectric material, such as alumina, to minimize the overall size of the balun. Each of the five transmission-line strips T1–T5 has a width/height ratio that determines its characteristic impedance and an overall length corresponding to a phase shift of 90°. To minimize the surface area of the balun, each of the transmission-line strips is formed in a meander pattern. The resistive impedance R illustrated in FIG. 2 is a chip resistor electrically connected between first and second conductive layers. The first conductive layer $L_1$ is disposed on top of the chip and is electrically connected to the port C by means of a pair of electrical leads. The second conductive layer $L_2$ is disposed on one side and the bottom of the chip and is soldered to a conductive layer $L_3$ which is electrically connected via a through hole H to the ground plane on the opposite side of the substrate S.

In each of the meander patterns forming one of the transmission lines, adjacent linear segments forming the patterns are spaced apart by at least the width of the line segments and the number of bends is minimized. This minimizes coupling between different portions of the line, which coupling increases the line length required for a given phase shift. Further, the meander patterns for the transmission lines T1 and T2 are substantially identical, and those for the transmission lines T3 and T4 are substantially identical. Also, these four meander patterns are arranged symmetrically with respect to each other and are separated from each other by linear segments of the transmission lines which are not included in the meander patterns.

Table I lists the dimensions and impedances of each of the microstrip transmission lines T1–T5 illustrated in FIG. 2. Note that the lengths of each of these lines is approximately 17% longer, than would be required for straight lines, to compensate for right-angle corner bends and inter-line coupling. The substrate thickness is 381 μm and the conductive patterns forming the transmission lines are 5 μm-thick gold layers.

TABLE I

| | T1 | T2 | T3 | T4 | T5 |
|---|---|---|---|---|---|
| Width (μm) | 688 | 688 | 361 | 361 | 361 |
| Length (μm) | 36770 | 36770 | 37870 | 37870 | 37870 |
| Impedance (Ω) | 35 | 35 | 50 | 50 | 50 |

In operation, the balun combines signals applied to the input ports P1 and P2, phase shifted by 180°, and provides the combined signal at output port P3. The operating characteristics of the preferred embodiment described above are illustrated in the graphs of FIGS. 3, 4 and 5.

Figure 3:
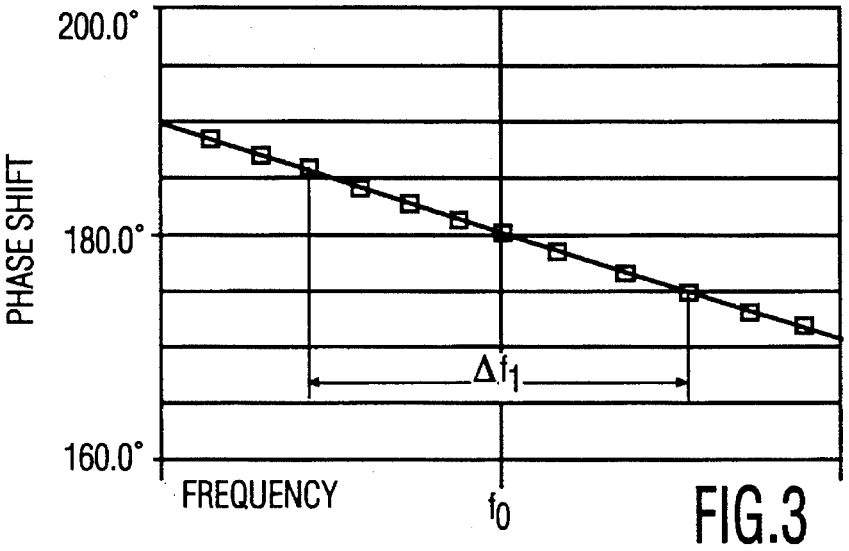
FIG. 3 is a graph illustrating phase shift characteristics of the balun of FIG. 2.

FIG. 3 illustrates the phase shift of the signal applied to port P1 relative to that applied to port P2 as detected at port P3. Note that over a bandwidth $\Delta f_1$ (shown) the phase shift varies by ±5° and over a bandwidth $\Delta f_2$ (not completely visible in FIG. 3) the phase shift varies by ±12°. For the exemplary balun illustrated in FIG. 2 and having the above-described dimensions, the center frequency and bandwidths are:

$f_0$=905 MHz $\Delta f_1$=30 MHz $\Delta f_2$=60 MHZ

Figure 4:
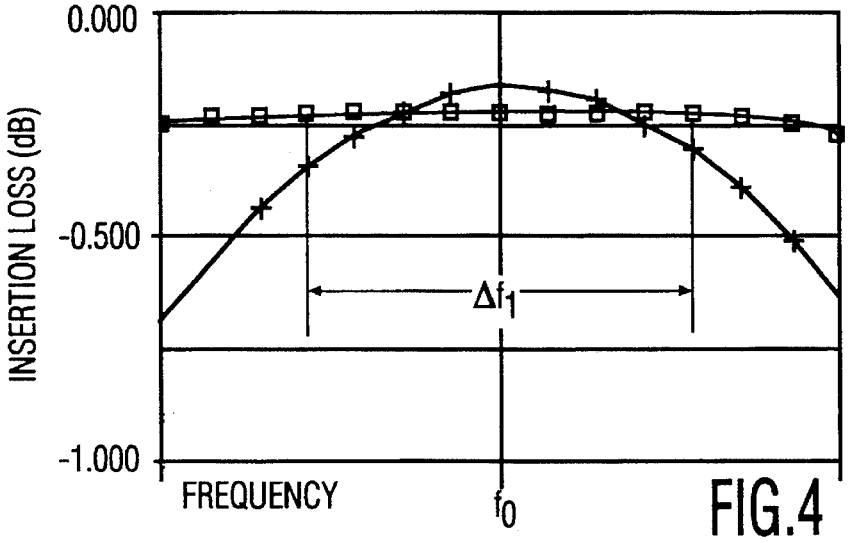
FIG. 4 is a graph illustrating insertion loss characteristics of the balun of FIG. 2.

FIG. 4 illustrates the respective insertion losses of the balun attributable to the signal path from P1 to P3 with P2 terminated (indicated by a rectangular symbol), and attributable to the signal path from P2 to P3 with P1 terminated (indicated by a cross symbol). The difference between the two insertion losses represents the degree of attenuation imbalance between the two paths. Note that the insertion loss from the input port P1 to the single output port P3 is almost flat over the entire illustrated frequency range. As a favorable consequence, transmission line T5 may be lengthened or shortened to compensate for too low or too high of a delay through the branch-line coupler without significantly affecting the degree of imbalance at any frequency.

Figure 5:
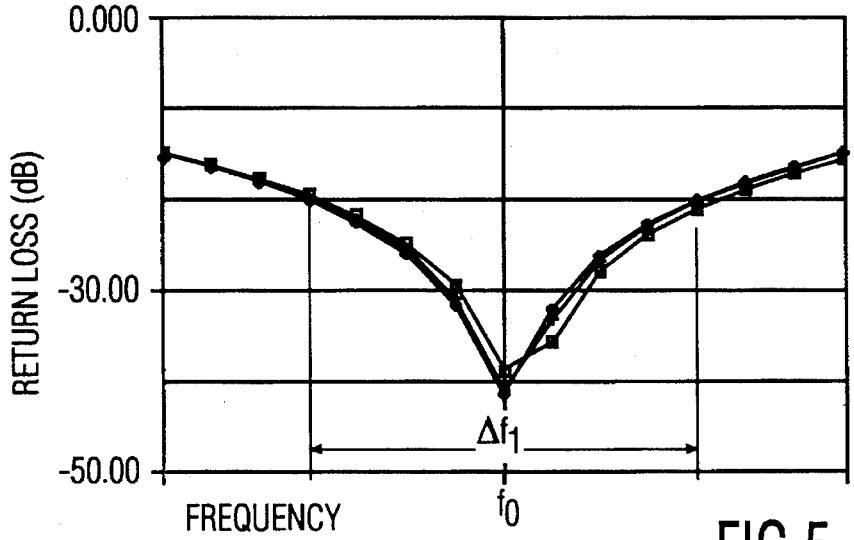
FIG. 5 is a graph illustrating passband characteristics of the balun of FIG. 2.

FIG. 5 illustrates the return loss (ratio of reflected power to incident power) at each port with the other ports terminated. The return loss at port P1 is indicated by a rectangle symbol, that at port P2 is indicated by a cross symbol, and that at port P3 is indicated by a diamond symbol. Note that over the entire bandwidth $\Delta f_1$ the return loss is lower than −20 DB.

Although one specific example of a microstrip balun in accordance with applicant's invention is has been described, numerous alternative embodiments are possible. For example, if multiple substrates are available the balun can be constructed in multilayers with different ones of the transmission line conductors being disposed on different ones of the substrates. This would both decrease the width and length of the space required for the balun and minimize coupling effects between different ones of the transmission lines.

As additional alternatives, the balun could be formed in stripline (with the microstrip conductors disposed between opposing ground planes) or by discrete components that are electrically connected to form a lumped-element equivalent of the balun.

I claim:

1. A microwave balun comprising:

a. a branch-line coupler having:

i. first and second inputs;

ii. first and second outputs;

iii. a first delay element having a characteristic impedance of $Z_0/\sqrt{2}$ and coupling the first input to the first output through a phase shift of 90°;

iv. a second delay element having a characteristic impedance of $Z_0/\sqrt{2}$ and coupling the second input to the second output through a phase shift of 90°;

v. a third delay element having a characteristic impedance of $Z_0$ and coupling the first and second inputs through a phase shift of 90°;

vi. a fourth delay element having a characteristic impedance of $Z_0$ and coupling the first and second outputs through a phase shift of 90°;

b. a fifth delay element having a characteristic impedance of $Z_0$ and coupling the first input of the branch-line coupler to a first input of the balun through a phase shift of 90°; and c. impedance means having a characteristic impedance of $Z_0$ terminating the first output;

said second input of the branch-line coupler comprising a second input of the balun and said second output of the branch-line coupler comprising an output of the balun.

2. A microwave balun including a dielectric substrate supporting a conductive layer forming a ground plane and further supporting:

a. a conductive pattern defining a branch-line coupler, said coupler having:

i. first and second inputs;

ii. first and second outputs;

iii. first transmission line means having a characteristic impedance of $Z_0/\sqrt{2}$ and coupling the first input to the first output through a phase shift of 90°;

iv. second transmission line means having a characteristic impedance of $Z_0/\sqrt{2}$ and coupling the second input to the second output through a phase shift of 90°;

v. third transmission line means having a characteristic impedance of $Z_0$ and coupling the first and second inputs through a phase shift of 90°;

vi. fourth transmission line means having a characteristic impedance of $Z_0$ and coupling the first and second outputs through a phase shift of 90°;

b. fifth transmission line means having a characteristic impedance of $Z_0$ and coupling the first input of the branch-line coupler to a first input of the balun through a phase shift of 90°; and c. impedance means having a characteristic impedance of $Z_0$ terminating the first output;

said second input of the branch-line coupler comprising a second input of the balun and said second output of the branch-line coupler comprising an output of the balun.

3. A microwave balun as in claim 1 or 2 where at least the branch-line coupler is formed in stripline.

4. A microwave balun as in claim 1 or 2 where at least the branch-line coupler is formed in microstrip.

5. A microwave balun as in claim 2 where at least one of the transmission line means comprises a meander conductive pattern formed on the dielectric substrate.

6. A microwave balun as in claim 2 where at least the first, second, third and fourth transmission line means each comprise a conductive pattern formed on the dielectric substrate and including a meander pattern and a linear segment, said meander patterns being arranged adjacent to each other and at least one of said linear segments being disposed between each meander pattern and each adjacent meander pattern.

7. A microwave balun as in claim 2 where at least the first, second, third and fourth transmission line means each comprise a conductive pattern formed on the dielectric substrate and including a meander pattern including adjacent linear segments having a predetermined width which are spaced apart by at least said width.

8. A microwave balun as in claim 6 or 7 where the meander patterns of the first, second, third and fourth transmission lines are arranged symmetrically with respect to each other.

* * * * *